US009687980B2

(12) United States Patent
Yeh

(10) Patent No.: US 9,687,980 B2
(45) Date of Patent: Jun. 27, 2017

(54) TOOL STORAGE DEVICE

(71) Applicant: Shu-Hui Yeh, Fuxing Township (TW)

(72) Inventor: Shu-Hui Yeh, Fuxing Township (TW)

( * ) Notice: Subject to any disclaimer, the term of this patent is extended or adjusted under 35 U.S.C. 154(b) by 0 days.

(21) Appl. No.: 15/088,506

(22) Filed: Apr. 1, 2016

(65) Prior Publication Data

US 2017/0014988 A1 Jan. 19, 2017

(30) Foreign Application Priority Data

Jul. 16, 2015 (TW) ..... 104211464 U

(51) Int. Cl.
*B65D 85/28* (2006.01)
*B25H 3/00* (2006.01)
*B25H 3/04* (2006.01)

(52) U.S. Cl.
CPC ..... *B25H 3/003* (2013.01); *B25H 3/04* (2013.01)

(58) Field of Classification Search
CPC ..... B25H 3/003; B25H 3/04
USPC ..... 206/379, 372, 373, 374, 375, 377, 378, 206/349, 564, 565; 211/69
See application file for complete search history.

(56) References Cited

U.S. PATENT DOCUMENTS 746,014 A * 12/1903 Callahan ..... B65D 65/22 206/521
2,545,611 A * 3/1951 Flannery ..... D04B 3/00 206/380
3,154,192 A * 10/1964 Cowley ..... B65D 85/24 206/379
4,588,082 A * 5/1986 Ridings ..... A45C 3/00 206/303
5,520,285 A * 5/1996 Mursch ..... B25H 3/003 206/373
5,813,532 A * 9/1998 Kheradpir ..... B25H 3/003 206/379
5,918,741 A * 7/1999 Vasudeva ..... B25H 3/003 206/234
8,069,983 B2 * 12/2011 Cross ..... B27B 5/29 206/303
2002/0179473 A1 * 12/2002 Chao ..... B25H 3/003 206/379
2006/0131472 A1 * 6/2006 Lee ..... B25H 3/003 248/682
2016/0053987 A1 * 2/2016 Hsu ..... F21V 23/04 206/372

* cited by examiner

*Primary Examiner* — Jacob K Ackun
*Assistant Examiner* — Jenine Pagan
(74) *Attorney, Agent, or Firm* — Trop Pruner & Hu, P.C.

(57) ABSTRACT

The tool storage device includes a base plate, a storage unit, and a coupling unit. The base plate has at least three main plate portions, a hanging plate portion space apart from an endmost one of the main plate portions, a plurality of bendable plate portions, and opposite front and rear surfaces. Each of the front and rear surfaces extend across the hanging plate portion and the main plate portions. The storage unit has a plurality of spaced-apart first storage portions mounted on the front surface and disposed at the main plate portions. The coupling unit has an engaging hole formed in the hanging plate portion, and an engaging block mounted on the rear surface and fittingly engageable with the engaging hole.

2 Claims, 6 Drawing Sheets

TOOL STORAGE DEVICE

CROSS-REFERENCE TO RELATED APPLICATION

This application claims priority of Taiwanese Patent Application No. 104211464, filed on Jul. 16, 2015.

FIELD

The disclosure relates to a storage device, and more particularly to a tool storage device adapted for storing tool bits or sockets.

BACKGROUND

Referring to FIG. 1, a conventional tool storage device 1 of Taiwanese Utility Model Patent No. M261345 includes a box body 11 and a replaceable retaining seat 12. The box body 11 includes a center plate portion 111 and two side cover portions 112 extending in opposite directions away from the center plate portion 111. Each of the side cover portions 112 has a folding section 113 to facilitate the folding of the two side portions 112 towards and engagingly with each other. However, the socket seat 12 of the conventional tool storage device 1 can only be coupled, albeit removably, to the center plate portion 111 and cannot be coupled to the side cover portions 112, resulting in inefficient space utilization within the conventional tool storage device 1. In addition, since the box body 11 has large weight and mass, the conventional tool storage device 1 also leaves much to be desired in terms of portability.

Referring to FIG. 2, a conventional tool storage device 2 of Taiwanese Utility Model Patent No. 275831 includes a main body 21, a trapezoid intermediary part 22 disposed within the main body 21, and a cover 23 to be sleeved over and around the main body 21. The main body 21 has a center plate portion 211 that allows the intermediary part 22 to be fixed thereon, and two extending portions 212 that extend toward each other respectively from two lateral sides of the center plate portion 211. The extending portions 212 adhere against each other and against the intermediary part 22, and are each formed with a plurality of clamp cavities 213 that allow placement of tool bits or sockets therein.

However, since the cross-section of the main body 21 is roughly in the shape of an isosceles triangle, the center of gravity lies closer to the top so that the conventional tool storage device 2 topples over easily. Furthermore, since each of the extending portions 212 is formed with a plurality of the clamp cavities 213, the structural strength of the main body 21 is in fact low, requiring the intermediary part 22 for support. Moreover, to prevent the tools in the clamp cavities 213 from falling out, the cover 23 is further required for blocking. The need for the intermediary part 22 and the cover 23 inevitably results in a heavier overall weight of the conventional tool storage device 2.

SUMMARY

Therefore, an object of the disclosure is to provide a tool storage device that can alleviate at least one of the drawbacks of the prior art.

The tool storage device includes a base plate, a storage unit, and a coupling unit. The base plate has at least three main plate portions that are spaced apart in a first direction, a hanging plate portion that is space apart from an endmost one of the at least three main plate portions in the first direction, and a plurality of bendable plate portions. Each of the bendable plate portions has a thickness that is smaller than that of the at least three of the main plate portions, with one of the bendable plate portions being connected between the hanging plate portion and the endmost one of the at least three main plate portions, and with each of the remainder of the bendable plate portions being connected between a respective adjacent pair of the main plate portions. The base plate further has opposite front and rear surfaces, which each extend across the hanging plate portion and the at least three main plate portions.

The storage unit has a plurality of spaced-apart first storage portions that are mounted on the front surface and that are disposed at the at least three main plate portions of the base plate.

The coupling unit has an engaging hole that is formed in the hanging plate portion of the base plate and that extends through the front and rear surfaces, and an engaging block that is mounted on the rear surface, that is disposed on one of the at least three main plate portions which is farthest from the endmost one of the at least three main plate portions, and that is fittingly engageable with the engaging hole.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
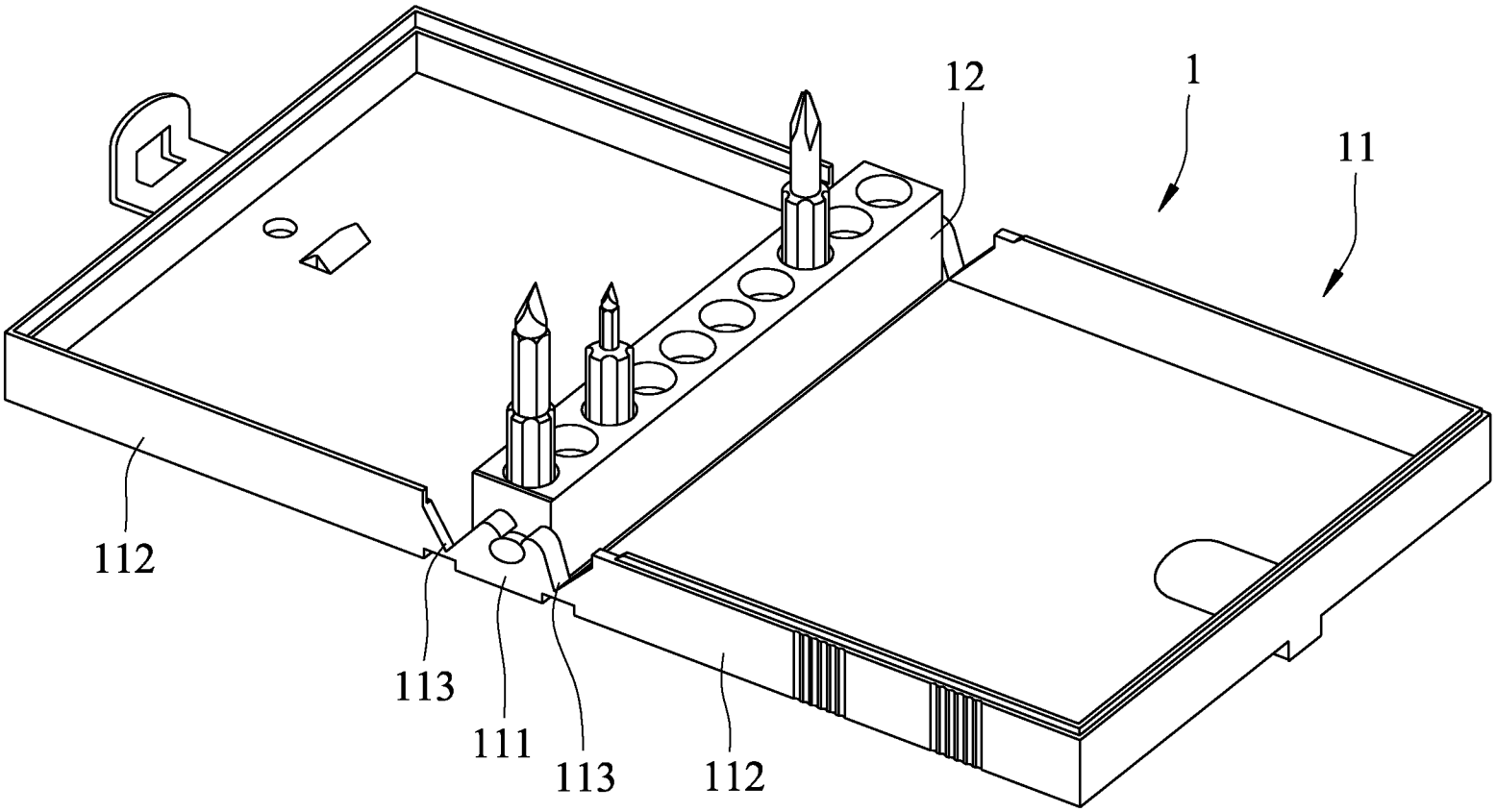
FIG.1 PRIOR ART
FIG. 1 is a perspective view illustrating a conventional tool storage device according to Taiwanese Utility Model Patent No. M261345.
Figure 2:
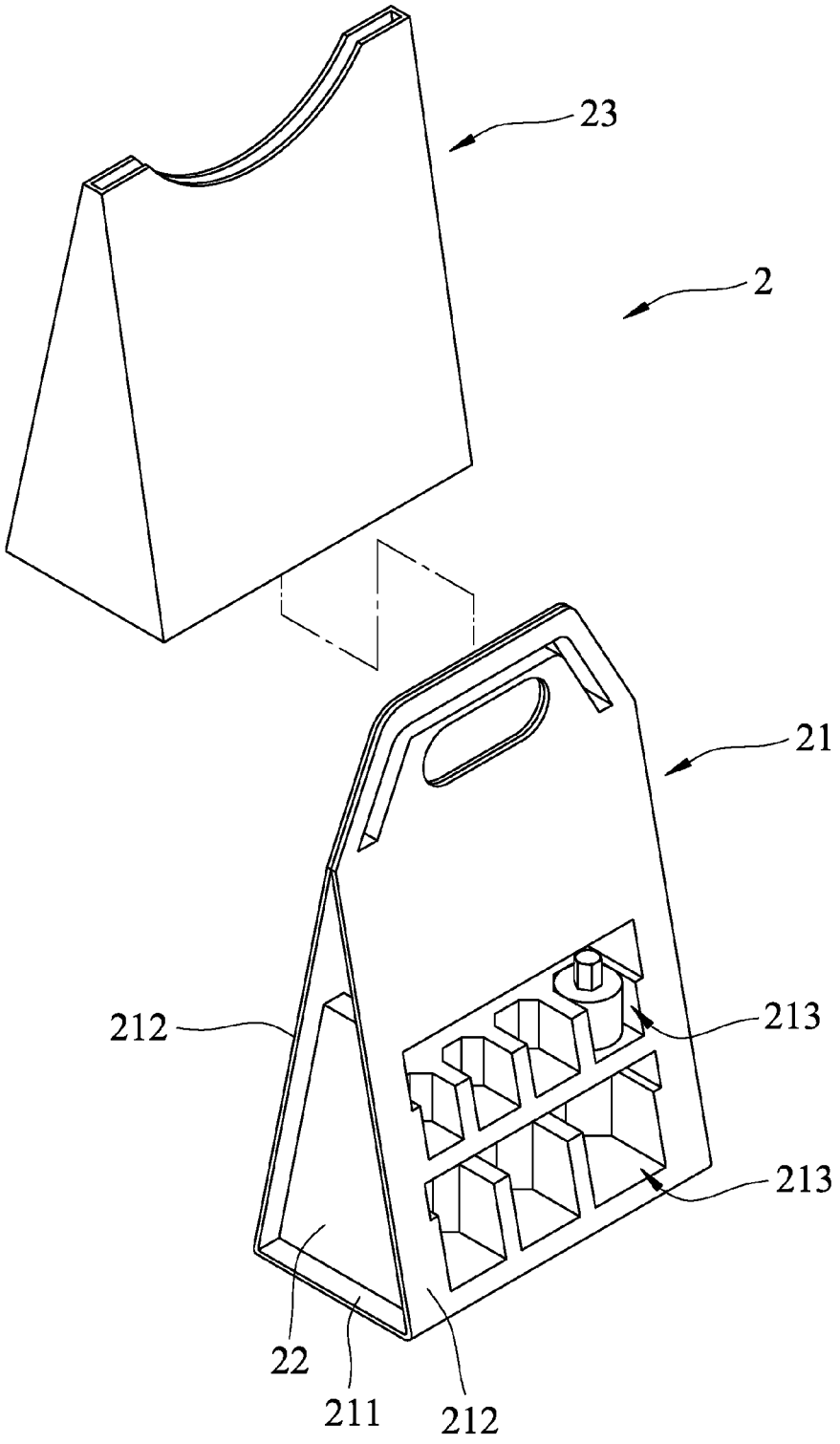
FIG.2 PRIOR ART
FIG. 2 is a perspective view illustrating another conventional tool storage device according to Taiwanese Utility Model Patent Publication No. 275831.
Figure 3:
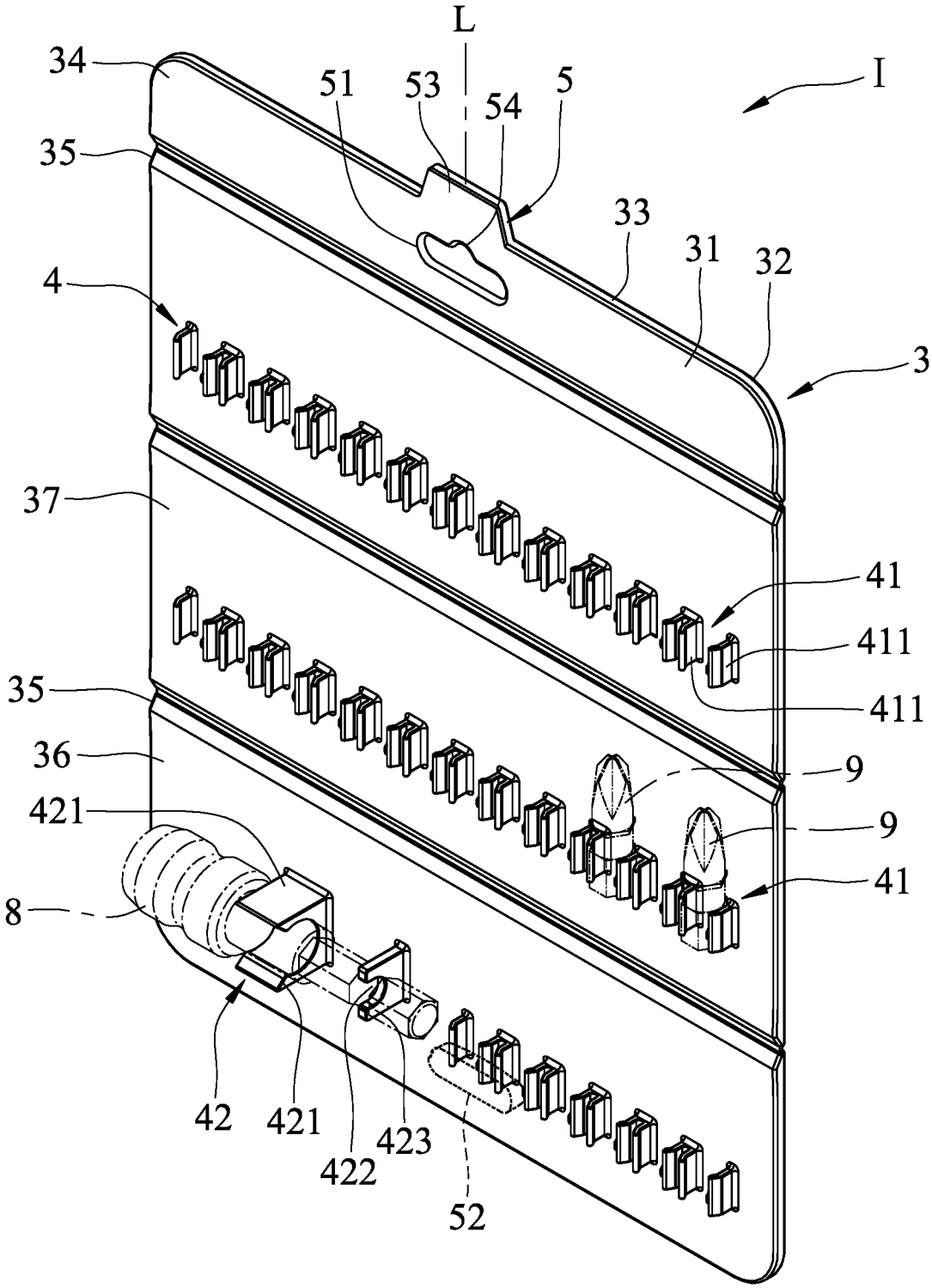
FIG. 3 is a perspective view illustrating an embodiment of a tool storage device according to the disclosure being at an opened state.
Figure 4:
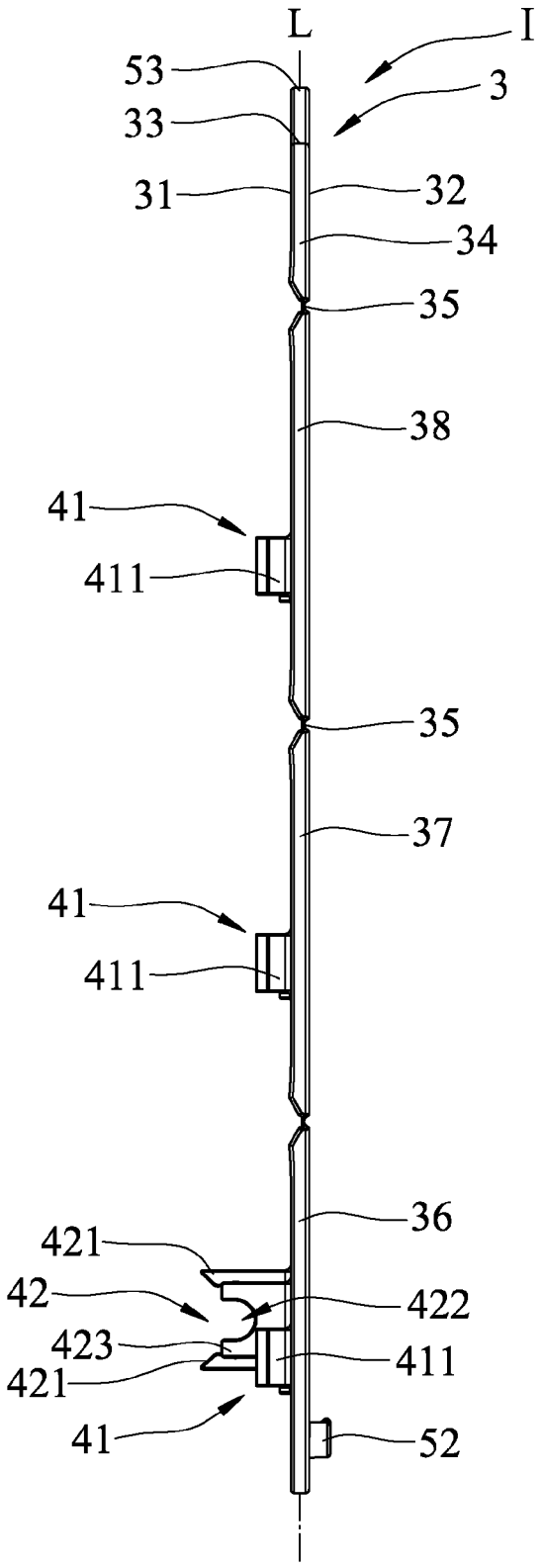
FIG. 4 is a side view of the embodiment, illustrating an engaging block being disposed on the first main plate portion of the base plate and being mounted on the rear surface of the base plate.
Figure 5:
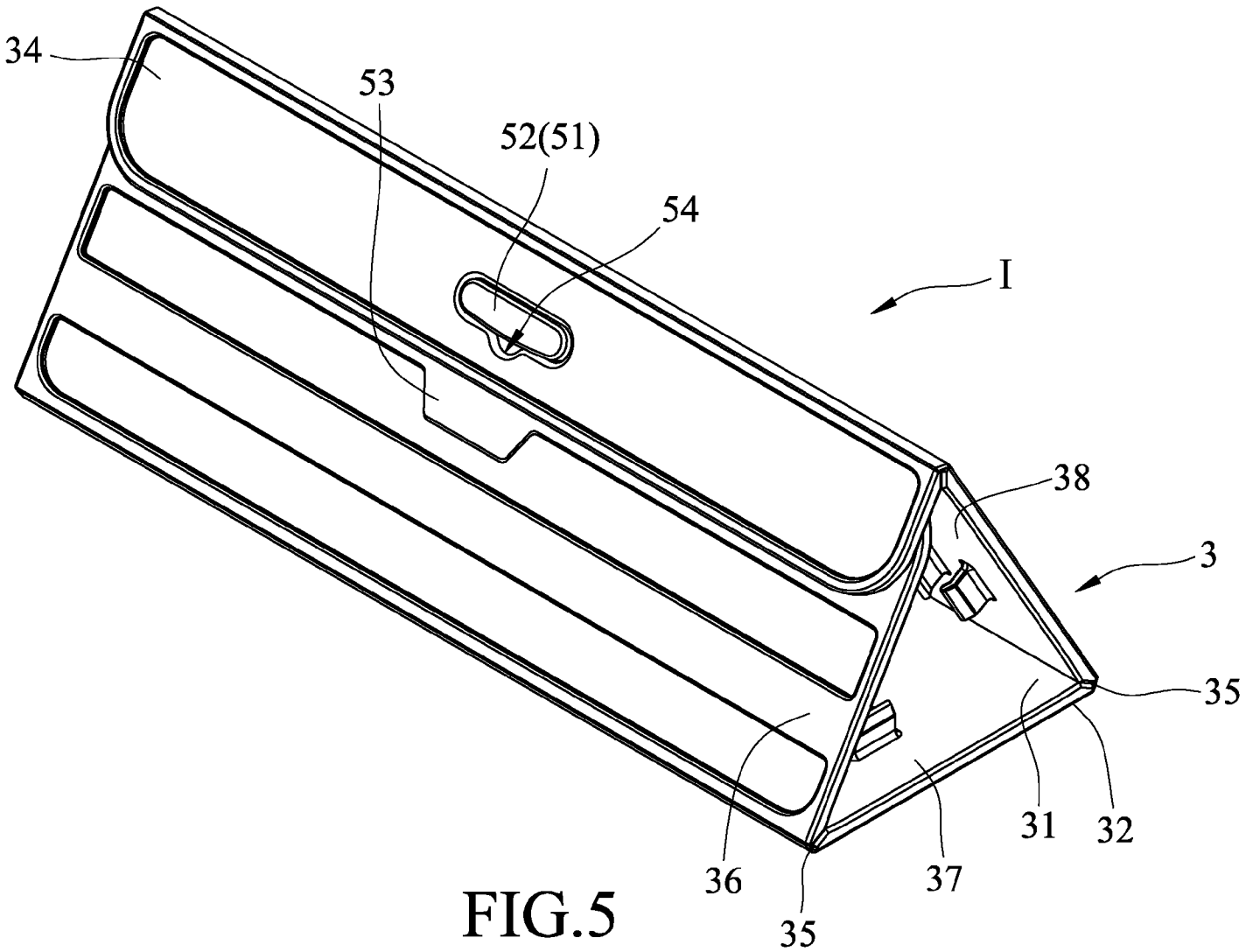
FIG. 5 is a perspective view of the embodiment, illustrating the embodiment in a closed state.

Referring to FIGS. 3 to 5, the embodiment of a tool storage device (I) according to the disclosure is adapted for storing screwdriver bits 9 of various sizes, and includes a base plate 3, a storage unit 4, and a coupling unit 5.

The base plate 3 has at least three main plate portions that are spaced apart in a first direction (L), a hanging plate portion 34 that is spaced apart from an endmost one of the at least three main plate portions in the first direction (L), and a plurality of bendable plate portions 35. Each of the bendable plate portions 35 has a thickness that is smaller than that of the at least three of said main plate portions, with one of the bendable plate portions 35 being connected between the hanging plate portion 34 and the endmost one of the at least three main plate portions, and each of the remainder of the bendable plate portions 35 being connected between a respective adjacent pair of the main plate portions. The base plate 3 further has opposite front and rear surfaces 31, 32, and a side surface 33 that interconnects the front and rear end surfaces 31, 32. Each of the front and rear surfaces 31, 32 extends across the hanging plate portion 34 and the at least three main plate portions.

In this embodiment, the base plate 3 has a first main plate portion 36, a second main plate portion 37, and a third main plate portion 38. A ratio of a width of the first main plate portion 36 in the first direction (L) to a width of the third main plate portion 38 in the first direction (L) ranges between 0.9 and 1. A ratio of a width of the second main plate portion 37 in the first direction (L) to the width of the third main plate portion 38 in the first direction (L) ranges between 0.9 and 1.

The storage unit 4 has a plurality of spaced-apart first storage portions 41 that are mounted on the front surface 31 and that are disposed at the three main plate portions 36, 37, 38 of the base plate 3. Each of the first storage portions 41 includes two first storage walls 411 that are spaced apart from each other in a second direction perpendicular to the first direction (L) so that each of the screwdriver bits 9 can be fixedly clamped between the two first storage walls 411 with the lengthwise direction thereof being parallel to the first direction (L).

The storage unit 4 further has a second storage portion 42 that is mounted on the front surface 31 of the base plate 3, that is disposed at one of the three main plate portions 36, 37, 38, and that includes two second storage walls 421 extending in the second direction and being spaced apart from each other in the first direction (L), and an auxiliary storage wall 423 that is close to the second storage walls 421, and that is formed with a fixing groove 422. It should be noted that a maximum distance between the second storage walls 421 in the first direction (L) is larger than a maximum width of the fixing groove 422 in the first direction (L), thereby enabling the fixing and storage of a hand tool 8 possessing different outer diameters therebetween along the second direction.

The coupling unit 5 has an engaging hole 51 that is formed in the hanging plate portion 34 of the base plate 3 and that extends through the front and rear surfaces 31, 32, and an engaging block 52 that is mounted on the rear surface 32, that is disposed on one of the three main plate portions 36, 37, 38 which is farthest from the endmost one of the at least three main plate portions 36, 37, 38, and that is fittingly engageable with the engaging hole 51. In this embodiment, the engaging block 52 is disposed on the first main plate portion 36.

The coupling unit 5 of this embodiment further has a grip block 53 that is disposed on the hanging plate portion 34 of the base plate 3 and that projects from the side surface 33 away from the engaging hole 51, and a hanging hole 54 that is formed in the hanging plate portion 34, that extends through the front and rear surfaces 31, 32, that is in spatial communication with the engaging hole 51, and that is disposed between the engaging hole 51 and the grip block 53.

When the first main plate portion 36 is away from the hanging plate portion 34, the tool storage device (I) is at an opened state (see FIGS. 3 and 4). This provides a user with a clear and open view of the entire front surface 31 of the base plate 3 and the tools stored thereon, so that a desired tool can be quickly selected. In this state, the tool storage device (I) can alternatively be hung on a wall (not shown) to exhibit all readily available tools.

Figure 6:
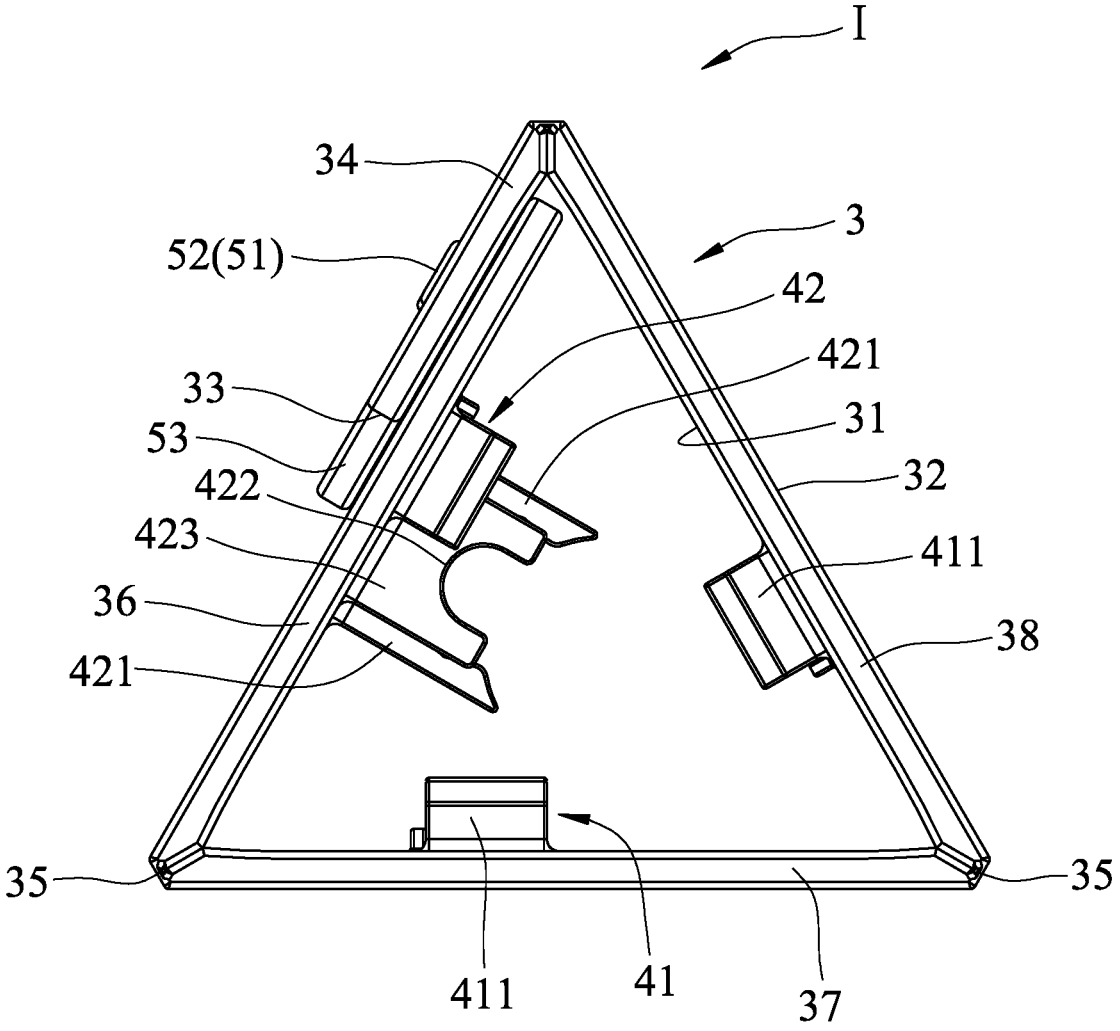
FIG. 6 is a side view illustrating the embodiment in the closed state and being folded to be substantially a hollow triangular prism.

When the first main plate portion 36 of the base plate 3 is brought adjacent to the hanging plate portion 34 and the engaging block 52 of the coupling unit 5 is engaged with the engaging hole 51, the tool storage device (I) is at a closed state (see FIGS. 5 and 6). In this state, the tool storage device (I) is in the shape of a substantially equilateral triangular prism. The hollow prism shape of the tool storage device (I) enables users to clearly see each of the first and second storage portions 41, 42 and determine at a glance the utilization rate of the tool storage device (I). In addition, since a gravity center of the equilateral triangular prism is located lower than that of an isosceles triangular prism, the structural stability of the tool storage device (I) is superior to that of the abovementioned conventional tool storage device 2, making it less probable to lean and topple.

It should be noted that the grip block 53 of the coupling unit 5 provides a focus point for the user to apply force, so that the engaging block 52 can be easily detached from the engaging hole 51 when the tool storage device (I) is at the closed state.

The advantages of the tool storage device I according to the disclosure can be listed as follows.

1. With the design that each of the main plate portions 36, 37, 38 is disposed with the first storage portions 41, the tool storage device (I) of the present disclosure can more effectively utilize the space provided on the base plate 3, and can either be spread open on a flat surface or hung on a wall for convenient use.

2. The tool storage device (I) has a plurality of bendable plate portions 35, a coupling unit 5, and first, second, and third main plate portions 36, 37, 38 that have substantially the same length along the first direction (L), thus allowing the tool storage device (I) to be folded close into a substantially equilateral triangular prism that is structurally stable. Furthermore, since all tools to be stored can be fixedly enclosed within the prism, no additional cover 23 of the conventional tool storage device 2 is necessary, thereby saving manufacture costs.

3. In comparison to the aforementioned conventional tool storage device 2, by dispensing with the cover 23 and the intermediary part 22, the overall weight of the tool storage device (I) is lighter, thereby improving on the portability of relevant art.

In sum, the tool storage device (I) according to the disclosure has improved space utilization by virtue of the first storage portions 41 that are disposed on each of the first, second, and third main plate portions 36, 37, 38, and saves manufacture costs by virtue of the bendable plate portions 35 and the coupling unit 5 that allow the tool storage device (I) to close into a prism and prevent the tools stored therein from falling out.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A tool storage device comprising:

a base plate having at least three main plate portions that are spaced apart in a first direction, a hanging plate portion that is spaced apart from an endmost one of said at least three main plate portions in the first direction, and a plurality of bendable plate portions, each of said bendable plate portions having a thickness that is smaller than that of said at least three of said main plate portions, one of said bendable plate portions being connected between said hanging plate portion and said endmost one of said at least three main plate portions, each of the remainder of said bendable plate portions being connected between a respective adjacent pair of said main plate portions, said base plate further having opposite front and rear surfaces, each of said front and rear surfaces extending across said hanging plate portion and said at least three main plate portions;

a storage unit having a plurality of spaced-apart first storage portions that are mounted on said front surface and that are disposed at said at least three main plate portions of said base plate; and a coupling unit having an engaging hole that is formed in said hanging plate portion of said base plate and that extends through said front and rear surfaces, and an engaging block that is mounted on said rear surface, that is disposed on one of said at least three main plate portions which is farthest from said endmost one of said at least three main plate portions, and that is fittingly engageable with said engaging hole;

wherein said base plate has a first main plate portion, a second main plate portion, and a third main plate portion;

wherein a ratio of a width of said first main plate portion in the first direction to a width of said third main plate portion in the first direction ranges between 0.9 and 1;

wherein a ratio of a width of said second main plate portion in the first direction to the width of said third main plate portion in the first direction ranges between 0.9 and 1;

wherein, when said first main plate portion is brought adjacent to said hanging plate portion and said engaging block is engaged with said engaging hole, said tool storage device is at a closed state and is in the shape of a substantially equilateral triangular prism;

wherein each of said first storage portions includes two first storage walls that are spaced apart from each other in a second direction perpendicular to the first direction;

wherein said storage unit further has a second storage portion that is mounted on said front surface, that is disposed at one of said at least three main plate portions, and that includes two second storage walls spaced apart from each other in the first direction; and wherein said second storage portion further includes an auxiliary storage wall that is close to said second storage walls and that is formed with a fixing groove, a maximum distance between said second storage walls in the first direction being larger than a maximum width of said fixing groove in the first direction.

2. A tool storage device comprising:

a base plate having at least three main plate portions that are spaced apart in a first direction, a hanging plate portion that is spaced apart from an endmost one of said at least three main plate portions in the first direction, and a plurality of bendable plate portions, each of said bendable plate portions having a thickness that is smaller than that of said at least three of said main plate portions, one of said bendable plate portions being connected between said hanging plate portion and said endmost one of said at least three main plate portions, each of the remainder of said bendable plate portions being connected between a respective adjacent pair of said main plate portions, said base plate further having opposite front and rear surfaces, each of said front and rear surfaces extending across said hanging plate portion and said at least three main plate portions;

a storage unit having a plurality of spaced-apart first storage portions that are mounted on said front surface and that are disposed at said at least three main plate portions of said base plate; and a coupling unit having:

an engaging hole that is formed in said hanging plate portion of said base plate and that extends through said front and rear surfaces, and an engaging block that is mounted on said rear surface, that is disposed on one of said at least three main plate portions which is farthest from said endmost one of said at least three main plate portions, and that is fittingly engageable with said engaging hole;

wherein said base plate has a first main plate portion, a second main plate portion, and a third main plate portion;

wherein a ratio of a width of said first main plate portion in the first direction to a width of said third main plate portion in the first direction ranges between 0.9 and 1;

wherein a ratio of a width of said second main plate portion in the first direction to the width of said third main plate portion in the first direction ranges between 0.9 and 1;

wherein, when said first main plate portion is brought adjacent to said hanging plate portion and said engaging block is engaged with said engaging hole, said tool storage device is at a closed state and is in the shape of a substantially equilateral triangular prism;

wherein said base plate further has a side surface that interconnects said front and rear surfaces;

wherein said coupling unit further has a grip block that is disposed on said hanging plate portion of said base plate and that projects from said side surface away from said engaging hole; and wherein said coupling unit further has a hanging hole that is formed in said hanging plate portion of said base plate and that extends through said front and rear surfaces, that is in spatial communication with said engaging hole, and that is disposed between said engaging hole and said grip block.

* * * * *